United States Patent [19]

Young

[11] Patent Number: 4,716,619

[45] Date of Patent: Jan. 5, 1988

[54] MOPPING UNIT

[75] Inventor: Ronald A. Young, London, United Kingdom

[73] Assignee: Scot Young Service Systems Limited, Lye, England

[21] Appl. No.: 869,572

[22] Filed: Jun. 2, 1986

[30] Foreign Application Priority Data

Jun. 6, 1985 [GB] United Kingdom ..... 8514271

[51] Int. Cl.[4] ..... A47L 13/60

[52] U.S. Cl. ..... 15/262; 15/264

[58] Field of Search ..... 15/262, 260, 264

[56] References Cited

U.S. PATENT DOCUMENTS 1,679,980 8/1928 Lawlor ..... 15/262

3,921,247 11/1975 Cook ..... 15/262

FOREIGN PATENT DOCUMENTS 144354 11/1951 Australia ..... 15/262

1501316 2/1978 United Kingdom ..... 15/262

*Primary Examiner*—Edward L. Roberts

*Attorney, Agent, or Firm*—Collard, Roe & Galgano

[57] ABSTRACT

A mopping unit comprises a bucket, a wringer with two squeeze rollers mounted at the top of the bucket, and an operating mechanism to produce relative closing movement of the rollers. The operating mechanism comprises a foot pedal mounted at a lower level on the bucket and a toggle operating linkage operative on depression of the pedal to produce the relative closing movement of the rollers. At the end of the closing movement of the rollers the toggle linkage goes overcenter to lock the rollers at a predetermined spacing in an operative mop-wringing position.

11 Claims, 7 Drawing Figures

MOPPING UNIT

BACKGROUND OF THE INVENTION

1. Field of the Invention

The invention relates to mopping units as used with wet mopping systems, such a unit comprising a mop bucket combined with a wringer having two squeeze rollers between which a mop can be pulled upwards so as to be wrung out into the bucket.

2. Description of the Prior Art

Such units are in general use, the most common arrangement having a wringer with an upwardly projecting operating lever by which the squeeze pressure is applied after the mop has been inserted into the wringer. Thus wringing-out is a two-handed operation, requiring one hand to operate the lever while the mop is pulled through the wringer with the other hand. Foot-operated units are available but these have the disadvantage of requiring both feet to be used, one to operate the roller closing mechanism and the other to hold down the bucket. In both cases pressure has to be applied continuously to the operating member, by hand or foot, to maintain the desired squeeze pressure.

SUMMARY OF THE INVENTION

The object of the invention is to provide a foot-operated mopping unit which requires the use of only one foot, and which can be so designed that a preset squeeze pressure can be applied.

According to one aspect of the invention a mopping unit has a wringer with squeeze rollers mounted at the top of the bucket and an operating mechanism comprising a foot pedal mounted at a lower level on the bucket and a toggle operating linkage which, on depression of the foot pedal, produces relative closing movement of the squeeze rollers and goes over-center to lock the rollers at a predetermined spacing in the wringing position. Thus, for a given thickness of mop, a preset squeeze pressure is applied which is not dependent on the application of foot pressure.

Preferably one of the rollers is rotatable about an axis which remains at a fixed position, at the front of the bucket as the other or rear roller is moved towards it by two similar toggle linkages connected between the respective ends of the rear roller and the foot pedal. Each toggle linkage may have a projection or formation which can be engaged and moved by the foot to "break" the toggle and thus free the rear roller to move to an open position towards the rear of the bucket. The rear roller may be spring-urged to this open position, or positively moved thereto by foot pressure on said projection or formation. Alternatively, the arrangement may be such that a return spring acts to urge each toggle linkage to its normal open position whereas the reaction to the squeeze pressure in a mop being wrung out maintains each linkage in the locked over-center position, so that after the mop has been pulled through and left the rollers the spring operates to return the operating mechanism and rear roller to the inoperative rest position.

In order to adjust said predetermined spacing of the rollers when in the wringing position, in order to suit mopheads of different thicknesses or to suit the physical capabilities and desirable work loads of individual operatives, the operating mechanism may have an adjustable connection to each end of the movable rear roller. Each such connection may comprise a lever pivotally connected adjacent one end to the rear roller and at an intermediate position to an operating arm of the mechanism, this lever being engaged on the side of the arm pivot remote from the roller by an adjusting thumbscrew which is threaded into the arm. Alternatively the rotational axis of the rear roller may be fixed relative to the operating arms of the mechanism, with the position of the rotational axis of the front roller relative to the bucket being adjustable.

The foot pedal is preferably mounted in a recess at the front side of the bucket and positioned more or less directly below the rollers when in the wringing position. Thus foot pressure applied to the pedal directly opposes the upward pull applied to the mop while being wrung out and provides optimum assistance in holding the unit resting firmly on the floor.

The bucket is conveniently a plastic molding, for example of polypropylene, and it may have a sectional shape which provides ledges at either side of the top opening and over which the ends of the two rollers project. Thus the rollers are longer than the liquid-carrying body portion of the bucket, and the strands of the mop are kept away from the ends of the rollers and cannot become entangled with the roller mechanism. Said ledges may be formed at the bottom of a recess the depth of which is at least equal to the roller diameter, so that the rollers are disposed below the rim of the bucket to prevent splashing.

The bottom of the bucket is preferably maintained spaced above floor level, which allows the necessary pedal travel and foot access with a small front recess in the bucket and thus increases volume efficiency. To this end the bucket may be molded with bottom corner sockets, into which sockets either castors or stand-off "glider" legs can alternatively be fitted, according to requirements.

Other objects and features of the present invention will appear more fully below from the following detailed accompanying drawings which disclose two preferred embodiments of the invention. It is to be expressly understood, however, that the drawings are designed for purposes of illustration only and not as a definition of the limits of the invention, reference for the latter purpose being had to the appended claims.

DESCRIPTION OF THE PREFERRED EMBODIMENTS

Figure 1:
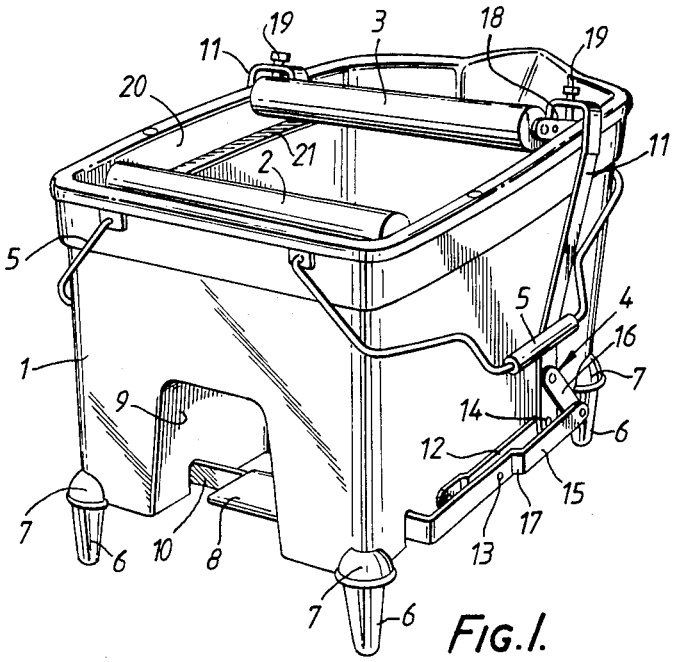
FIG. 1 is a perspective view of one embodiment showing wringer rollers thereof in the free or open position.
Figure 2:
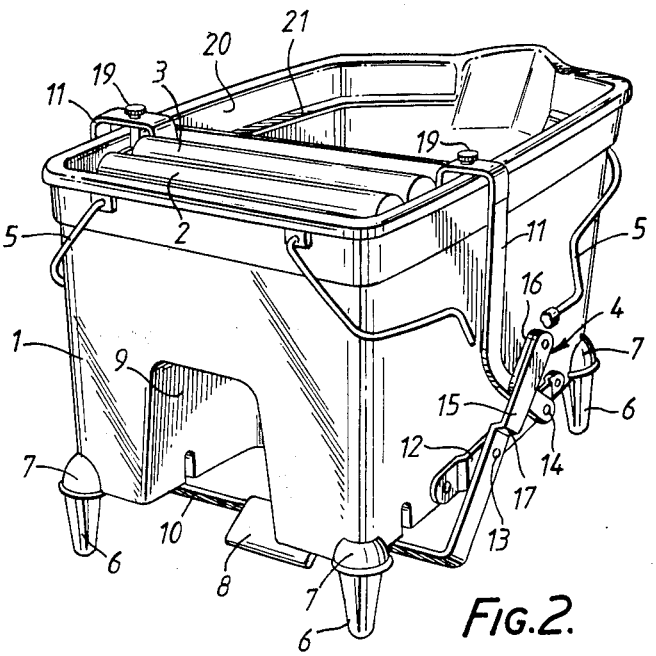
FIG. 2 is a similar view showing the rollers in the operative wringing position.

The mopping unit illustrated in FIGS. 1 and 2 comprises a molded plastic bucket 1, typically of 24 liters capacity, combined with a wringer having two rotatable squeeze rollers 2 and 3 disposed laterally of the bucket. One of the rollers 2 is at a fixed lateral position at the front of the bucket 1, and the other roller 3 is movable by an operating mechanism 4 between the free "open" position shown in FIG. 1 and the "closed" operative wringing position shown in FIG. 2. The bucket 1 has two bail-type handles 5 (one of which is partly broken away in FIG. 2) by which it can be carried by an operative, and has four stand-off legs 6 in the form of false "gliders" at the bottom corners of the bucket. These legs 6 maintain the bottom of the bucket 1 raised off the floor and they are fitted into corner sockets molded into the bucket 1 at 7. The legs 6 will glide reasonably freely over a suitably smooth floor but castors of the same effective height can be fitted into the sockets 7, instead of the legs 6, to provide increased mobility.

A foot-operated pedal 8 of the mechanism 4 is disposed at the bottom of a central recess 9 molded in the front vertical face of the bucket 1 at the bottom edge thereof. This pedal 8 is mounted on a U-shaped pedal bar 10 with side limbs which extend along either side of the bucket 1 and which are connected via toggle linkages to two operating arms 11 respectively connected to the two ends of the movable rear roller 3. The linkages are duplicated at the two sides of the bucket 1, and the right hand side which is shown in the drawings will now be described.

A mounting bracket 12 is attached to the side of the bucket 1 along the bottom edge thereof and supports a mounting pivot 13 for the corresponding side limb of the pedal bar 10. The corresponding operating arm 11 is pivotally mounted on the bracket 12 at 14, rearwardly of the pivot 13, and a toggle of the operating linkage comprises an end portion 15 of the pedal bar 10 and a pivotal link 16. At its ends the link 16 is respectively pivoted to the end of the portion 15 and to the arm 11.

To wring out a mop it is inserted into the bucket so as to hang down between the rollers 2 and 3 while the latter are in the open position shown in FIG. 1. The pedal 8 is then depressed to move the roller 3 to the operative position shown in FIG. 2, causing the toggle 15,16 to move just over center to a locked position defined by engagement of a stop (not shown) on the toggle portion 15. This locked condition of the toggle provides a predetermined spacing of the rollers 2 and 3 and the mop is wrung out as it is pulled upwardly by hand between the rollers 2 and 3. After the mop has been wrung out the toggle can be "broken" and the roller 3 returned to the open position by foot pressure on a joggled section 17 of the toggle portion 15. It will be appreciated that both toggles, on the two sides of the bucket 1, have first to be broken by foot pressure before the roller 3 can be returned to the open position.

The bucket 1 has a flat vertical front side in which the recess 9 is formed, and the pedal 8 is positioned directly below the gap between the rollers 2 and 3 when in the closed position of FIG. 2. Thus a foot can be placed on the pedal 8 to apply a downward force which directly opposes the upward pull on the mop as the latter is drawn upwardly while being wrung out.

The connection between each end of the roller 3 and the corresponding arm 11 allows adjustment of the predetermined roller gap when in the closed position of FIG. 2. At each end the roller is pivoted at the front end of a lever 18 which has a pivotal attachment to the corresponding arm 11. A thumbscrew 19 threaded into the arm 11 engages the lever 18 rearwardly of its pivotal attachment to provide means for adjusting the position of the axis of the roller 3 relative to the upper end of the arm 11.

At the front and sides the bucket 1 is molded with an upper edge recess 20. The front roller 2 is positioned within this recess 20 so that it does not substantially obstruct the top opening of the liquid-containing portion of the bucket 1, and the side portions provide ledges 21 over which the ends of the rollers 2 and 3 project. These ledges keep the strands of an inserted mop away from the ends of the rollers and, in particular, prevent them becoming entangled with the operating mechanism. It is thus not necessary to provide separately fitted "sleekers", as in prior units, to ensure that the ends of the mop strands are not left outside the ends of the rollers. The depth of the recess 20 is slightly greater than the common diameter of the rollers 2 and 3, so that the latter are disposed below the rim of the bucket 1 in order to prevent splashing.

The second embodiment illustrated in FIGS. 3 to 7 is basically of similar construction to that already described, corresponding parts are denoted by the same reference numerals increased by 100. The essential differences between the two embodiments will now be fully described.

Figure 5:
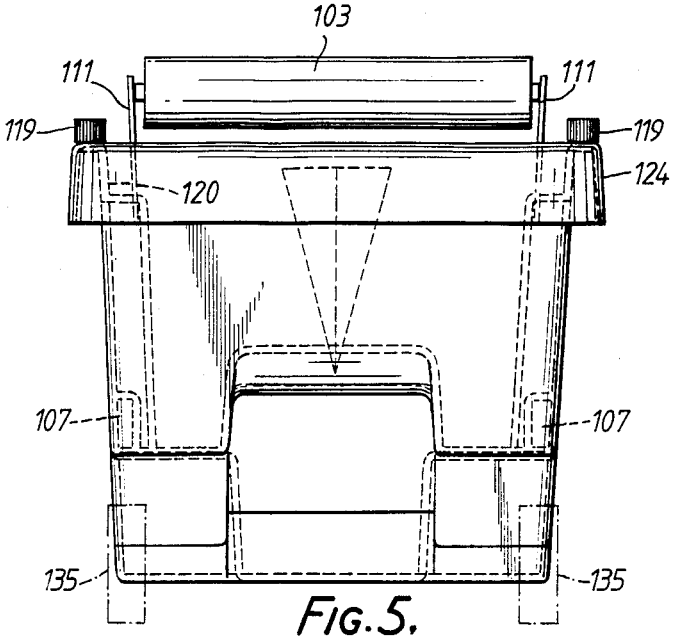
FIG. 5 is a diagrammatic end view of a the second embodiment with a front roller thereof not shown.
Figure 6:
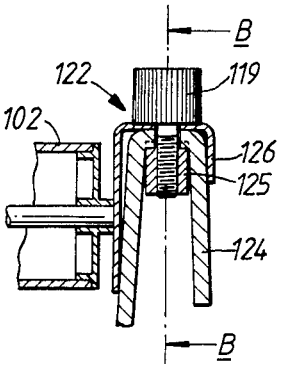
FIG. 6 is a part sectional view along the line A—A in FIG. 4.
Figure 7:
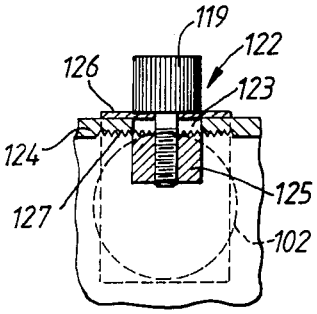
FIG. 7 is a sectional view along the line B—B in FIG. 6.

A movable rear roller 103 is pivotally mounted directly to the two operating arms 111, and a front fixed roller 102 is pivotally connected at each end to a bucket 101 about a fixed lateral axis defined by adjustable pivot mountings 122. With reference to FIGS. 5,6 and 7, the mountings 122 are each adjustably positioned along a respective slot 123 in a hollow rim section 124 of the bucket 101, and each comprise a thumbscrew 119, a nut 125 and a stirrup 126 on which the roller 102 is pivotally mounted. A region 127 is provided, on the underside of the rim section 124 around each slot 123, which is serrated for engagement by the similarly serrated top surface of the respective nut 125.

Figure 3:
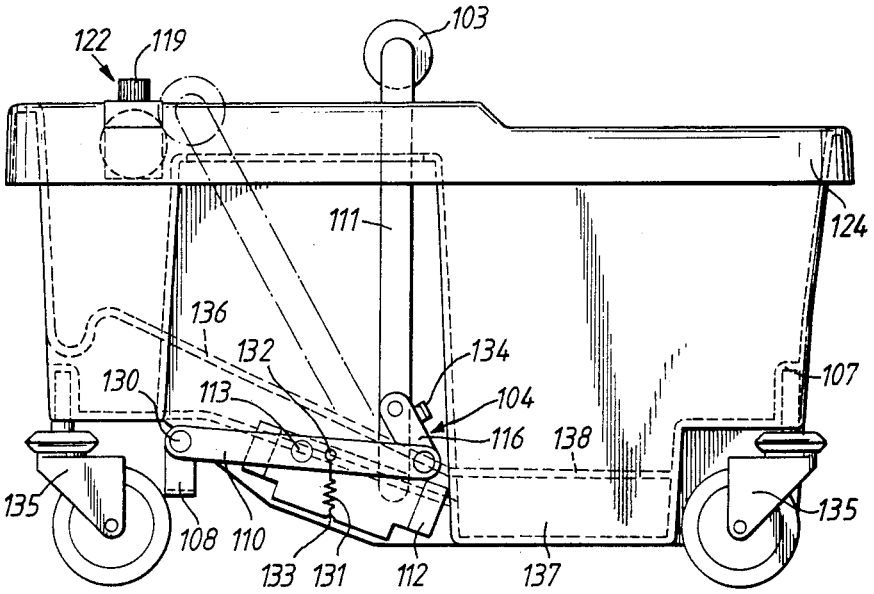
FIG. 3 is a diagrammatic side view of a second embodiment showing rollers thereof in the free position and in phantom in the operative position.
Figure 4:
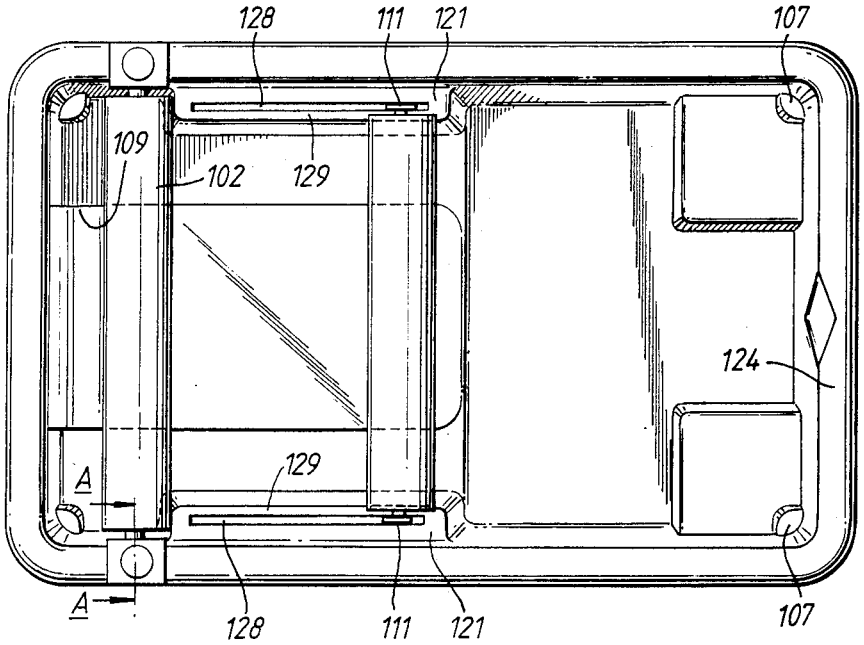
FIG. 4 is a diagrammatic partial top view of the second embodiment.

With reference to FIGS. 3 and 4, an operating mechanism 104 has operating arms 111 each of which extends through a respective slot 128 positioned in inwardly projecting portions 129 of side ledges 121. Pedal-operated levers 110 are pivotally mounted to brackets 112 fixed to the bucket 101, a stirrup foot pedal 108 is pivotally mounted to one end of each of the levers 110 at pivots 130. Return springs 131 are attached at upper ends thereof to pegs 132 on the respective lever 110 and, at lower ends thereof, to notches 133 in the respective bracket 112. A stop 134 is attached to each pivotal link 116 to limit the movement of the mechanism 104 at the over-center toggle position defining the operative forward position of the rear roller 103. Finally the sockets 107, positioned at the bottom corners of the bucket 101, each receive a castor 135 providing a floor support member.

The second embodiment operates in substantially the same manner as the first. However it is the front roller 102 which is now adjustable and the springs 131 act to return the rear roller 103 to the inoperative resting position. On depressing the foot pedal 108 the roller 103 is moved to the operative position adjacent the roller 102 and at a predetermined spacing therefrom with the pivotal links 116 going over-center with respect to the associated levers 110, the movement over-center being limited by the stops 134. On releasing the foot pedal 108 the springs 131 act to return the pivotal links 116 back over-center to the rest position, but for this to occur the roller 103 must first move closer to the roller 102 as the links 116 pass back over-center. When a mop is being wrung out the roller 103 cannot move closer to the roller 102 under the return spring force, which is considerably less than the reaction to the squeeze pressure acting on the mop, and so the pivotal links 116 are retained over-center until the mop has left the rollers, hence pressure on the pedal 108 does not have to be maintained to keep the roller 103 in the operative position. Once the mop is removed the action of the springs 131 returns the roller 103 to the rest position as the foot pedal 108 is released by the operative. Said adjustable predetermined spacing of the rollers 102 and 103 determine the squeeze pressure for a given thickness of mop, due to the use of the toggle mechanism 104, this pressure not being affected by the foot pressure which is applied to hold the bucket down as the mop is pulled through the rollers.

The top of the recess 109 is defined by a sloping portion 136 of the bottom of the bucket 101. Dirt and other particles collected by the mop and removed during wringing out of the latter fall down the sloping portion 136 and collect in a rear sump portion 137 of the bucket 101. A removable grill or plate 138 is positioned over the sump portion 137 to prevent the mop picking up the dirt that has collected in the sump portion 137.

What is claimed is:

1. A mopping unit comprising:

a bucket, a wringer with two squeeze rollers mounted at the top of the bucket, an operating mechanism having a foot pedal mounted at a lower level on the bucket and operative, of depression of the foot pedal, to produce relative closing movement of the squeeze rollers, one of said two rollers being mounted adjacent a front side of said bucket for rotation about an axis disposed laterally of the bucket and which remains fixed in position during said relative closing movement, and two operating arms which are respectively pivotally mounted on opposite sides of said bucket with the other of said two rollers rotatably mounted between upper ends of said arms, said operating mechanism including two similar toggle linkages each of which is operatively connected between a corresponding one of said arms and said foot pedal and which at the end of said closing movement both go over-center to lock the rollers at a predetermined spacing in an operative mop-wringing position.

2. A mopping unit according to claim 1, wherein each of said toggle linkages remains in said over-center roller-locking position until the toggle is "broken", a projection of the toggle linkage being engageable and movable by a foot of an operative for this purpose.

3. A mopping unit according to claim 1, wherein said bucket is a plastic molding with a sectional shape which provides ledges at either side of a top opening of the bucket, both end sections of each of said rollers respectively being co-extensive with said ledges.

4. A mopping unit according to claim 3, wherein each of said ledges is formed at the bottom of a recess at the corresponding side of the bucket, such recess being of a depth comparable with the diameter of said rollers.

5. A mopping unit according to claim 1, wherein said bucket has a bottom which in use is spaced above floor level, to this end the bucket being molded with bottom corner sockets into which floor support members are fitted.

6. A mopping unit according to claim 5, wherein said floor support members are castors which are interchangeable with stand-off "glider" legs.

7. A mopping unit comprising a molded plastics bucket, a pair of parallel squeeze rollers extending laterally of the bucket across an open top thereof, one of said rollers being disposed adjacent a front wall of the bucket and rotatable about a fixed axis which is adjustable fore-and-aft of the bucket, and the other of said rollers being disposed rearwardly of said one roller and mounted for movement from a rearward rest position to an operative position at a predetermined spacing from said one roller, said bucket being molded with a bottom front recess, a foot-operated pedal disposed within said recess and, at each side of said bucket, operating mechanism comprising a swingable roller support arm which at a lower end is pivotally supported by the bucket and which at an upper end rotatably supports a corresponding end of said other roller, a pedal-operated lever connected at a front end to said pedal and pivotally supported at an intermediate position along its length by said bucket, and a pivotal link pivotally attached adjacent respective ends between said pedal-operated lever, rearwardly of said pivotal support thereof, and said operating arm above the pivotal mounting thereof, whereby said lever and said link together form a toggle which goes over-center as said other roller reaches said operative position, stop means defining the over-center position of the toggle, and a return spring acting to urge said toggle away from said over-center position to a resting position corresponding to said resting position of said support arm.

8. A mopping unit according to claim 7, wherein said one roller is recessed within a top opening of the bucket and said other roller is disposed above the bucket when in said rearward rest position and positioned within a top opening of the bucket when in said operative position.

9. A mopping unit according to claim 8, wherein said two rollers are of substantially equal diameter.

10. A mopping unit comprising:

a bucket, a wringer with two squeeze rollers mounted at the top of the bucket, an operating mehanism having a foot pedal mounted at a lower level on the bucket, a toggle operating linkage operative, on depression of the foot pedal, to produce relative closing movement of the squeezed rollers, a stop engageable by said toggle linkage and a return spring which acts to urge said toggle linkage to a resting open position, at the end of said closing movement the toggle linkage engaging said stop at an over-center position of the toggle linkage which locks the rollers at a predetermined spacing in an operative mop-wringing position, the arrangement being such that a squeeze pressure applied to a mop while being wrung out between said rollers produces a reaction force acting on the toggle linkage in a direction to urge that linkage against said stop and thus maintain it in the cover-center position against the action of the return spring.

11. A mopping unit comprising:

a bucket, a wringer with two squeeze rollers mounted at the top of the bucket, an operating mechanism having a foot pedal mounted at a lower level on the bucket and operative, on depression of the foot pedal, to produce relative closing movement of the squeeze rollers, one of said two rollers being mounted adjacent a front side of said bucket for rotation about an axis disposed laterally of the bucket and which remains fixed in position during said relative closing movement, two operating arms which are respectively pivotally mounted on opposite sides of said bucket with the other of said two rollers rotatably mounted between upper ends of said arms, said operating mechanism including two similar toggle linkages each of which is operatively connected between a corresponding one of said arms and said foot pedal and which at the end of said closing movement both go over-center to lock the rollers at a predetermined spacing in an operative mop-wringing position, and manual adjustment means for adjusting the position of said axis of said one roller to adjust said predetermined spacing of said rollers.

* * * * *